United States Patent [19]

Snyder

[11] 3,936,775

[45] Feb. 3, 1976

[54] MULTICAVITY DUAL MODE FILTER

[75] Inventor: Richard V. Snyder, Old Bridge, N.J.

[73] Assignee: Harvard Industries, Inc., Farmingdale, N.J.

[22] Filed: Sept. 30, 1974

[21] Appl. No.: 510,167

[52] U.S. Cl...... 333/73 W; 333/21 A; 333/83 R

[51] Int. Cl.[2]..... H01P 1/16; H01P 1/20; H01P 7/06

[58] Field of Search... 333/21 R, 21 A, 73 R, 73 W, 333/83 R, 83 T, 98 R

[56] References Cited

UNITED STATES PATENTS

| | | | |
|---|---|---|---|
| 2,632,808 | 3/1953 | Lawson, Jr. et al. | 333/73 W |
| 2,694,186 | 11/1954 | Kinzer et al. | 333/73 W |
| 2,795,763 | 6/1957 | Tillotson | 333/73 W |
| 2,890,421 | 6/1959 | Currie | 333/73 W |
| 2,999,988 | 9/1961 | Marié | 333/83 R X |
| 3,697,898 | 10/1972 | Blachier et al. | 333/21 A |

OTHER PUBLICATIONS

Nelson – "Circularly Polarized Microwave Cavity Filters" in IRE Trans. on Microwave Theory and Techniques, Vol. MTT-5, No. 2, Apr. 1957; pp. 136–144.

*Primary Examiner*—James W. Lawrence
*Assistant Examiner*—Marvin Nussbaum
*Attorney, Agent, or Firm*—Allan Ratner

[57] ABSTRACT

A multicavity waveguide filter in which each of the cavities has a pair of orthogonally related modes of propagation. The cavities are positioned side by side with the long axis of each of the cavities being aligned parallel to each other. The cavities are tuned by tuning plungers which are simultaneously moved to predetermined positions within the cavity.

8 Claims, 10 Drawing Figures

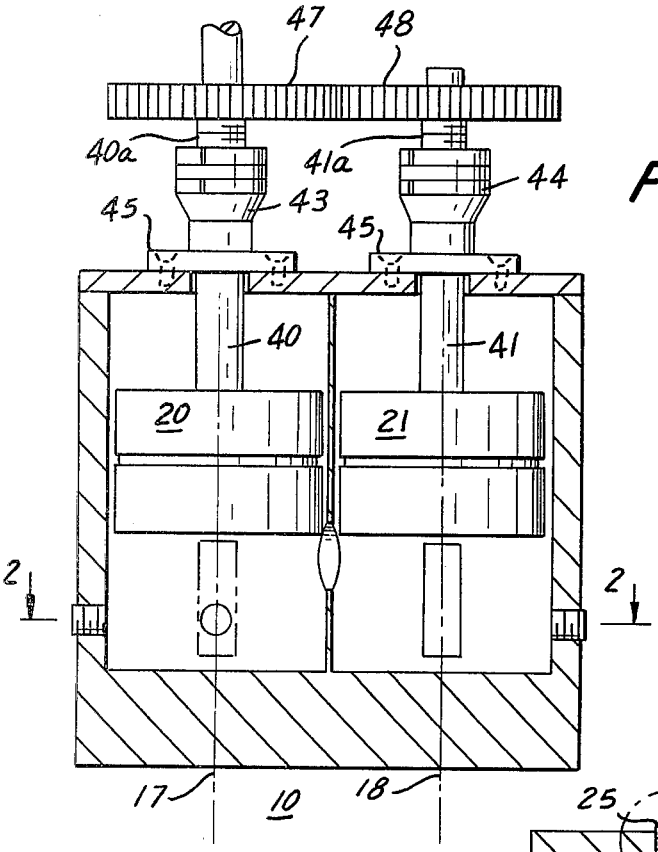
FIG. 1
FIG. 2A
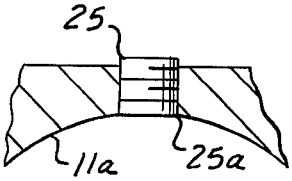
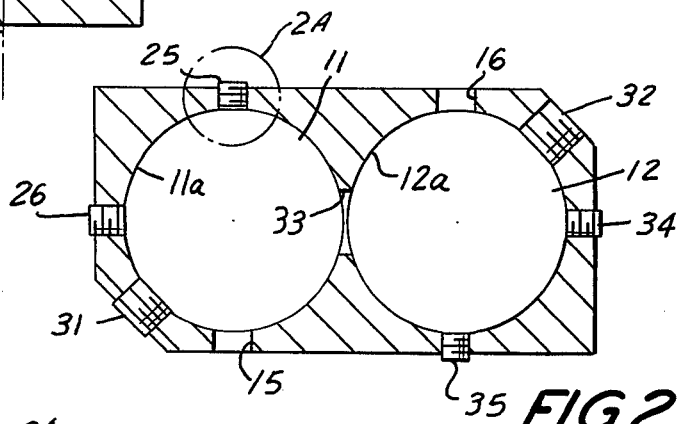
FIG. 2
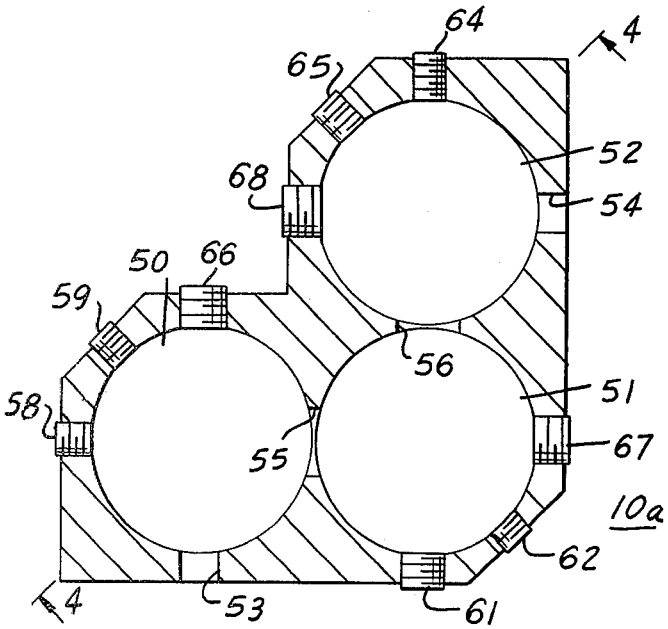
FIG. 3

FIG. 7
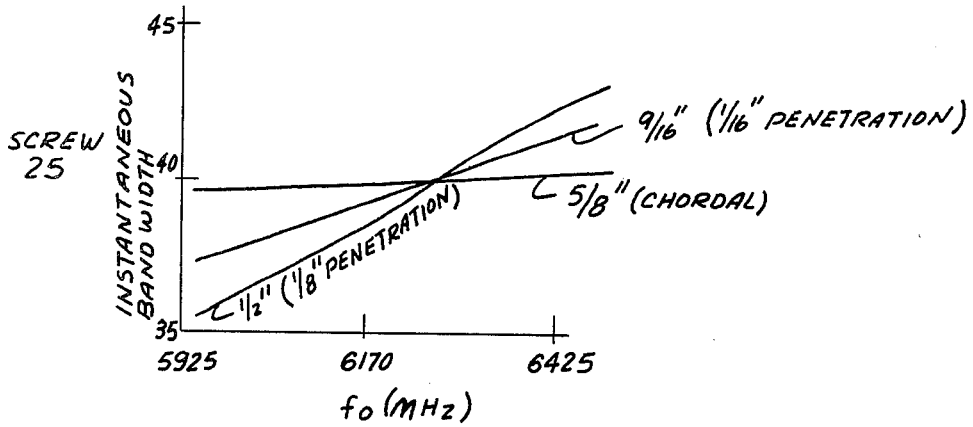
FIG. 8
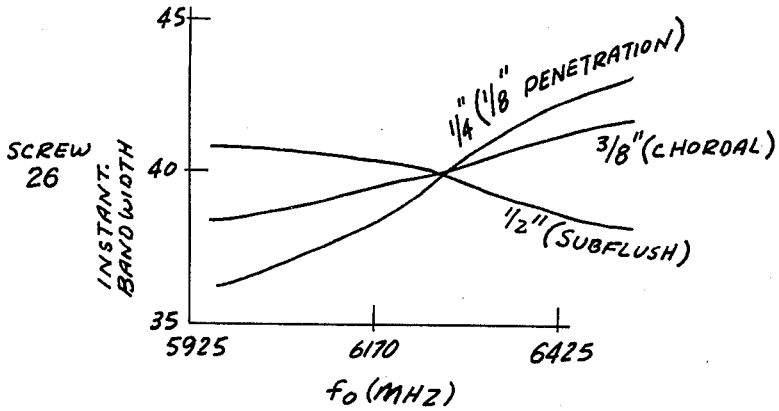
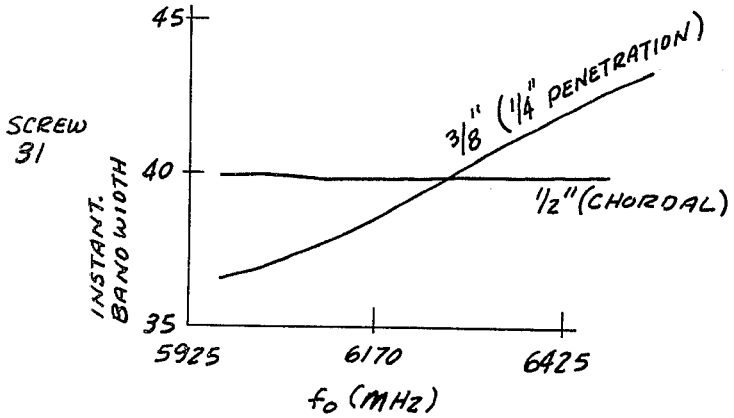
FIG. 9

MULTICAVITY DUAL MODE FILTER

BACKGROUND OF THE INVENTION

A. Field of the Invention

This invention relates to the field of microwave filters.

B. Prior Art

Multicavity band pass waveguide filters are known having two or more cavities in which each of the cavities resonates in two orthogonal modes and are coupled together through an iris in a correct sequence as shown in U.S. Pat. Nos. 3,697,898, 2,999,988 and 2,795,763. This coupling realizes a proscribed response characteristic. The coupling between the modes in each of the cavities is provided by a structural discontinuity or obstacle in the cavity such as a splitting screw. The resonate frequency of each mode within each cavity is adjusted by a respective tuning screw. In this way for a two cavity system, there are required two tuning screws in each of the cavities.

In such prior systems, each of the cavities is non-tunable with an input applied to the circular cross sectional end of one cavity and the output taken from the opposing circular cross sectional end of the last cavity. Coupling between the cavities is provided by an iris positioned in a circular cross sectional separating each pair of cavities. Such two cavity filters have not been tunable because the input and output circular cross sectional ends have not been practically moveable. In such three cavity filters, it is topologically impossible to achieve an equal cavity length for each cavity simultaneously. While dual mode single cavity tunable filters have been known, these filters do not lend themselves to multiple cavity construction.

The tunability of waveguide filters is very important in the field of communications and particularly in the preselection of frequencies for receivers and postselection of frequencies for transmitters.

SUMMARY OF THE INVENTION

A multicavity dual mode waveguide filter having a plurality of cylindrical cavities. Each of the cavities has a pair of orthogonally related modes of propogation. The cavities are positioned side by side in a series with the long axis of each of the cavities being aligned parallel to each other but not coaxial. Irises are formed on the sidewalls of the cavities for coupling selected ones of the cavities. Each of the cavities have obstacle splitting means for coupling each pair of orthogonally related modes within the cavity. A tuning plunger is provided for each of the cavities. The tuning plungers are mechanically coupled to each other so that they may be moved simultaneously to predetermined positions within the respective cavities.

BRIEF DESCRIPTION OF THE DRAWINGS

FIG. 1 illustrates a sectional side view of a two cavity dual mode waveguide filter in accordance with the invention;

FIG. 2 is a top sectional view of FIG. 1 taken along lines 2—2;

FIG. 2A is an enlarged view of a tuning screw and portion of a sidewall of FIG. 1;

FIG. 3 is a top sectional view of a three cavity dual mode waveguide filter according to another embodiment of the invention;

FIGS. 7–9 are curves which plot bandwidth with respect to center frequency for differing values of screw diameter.

DETAILED DESCRIPTION

Figure 4:
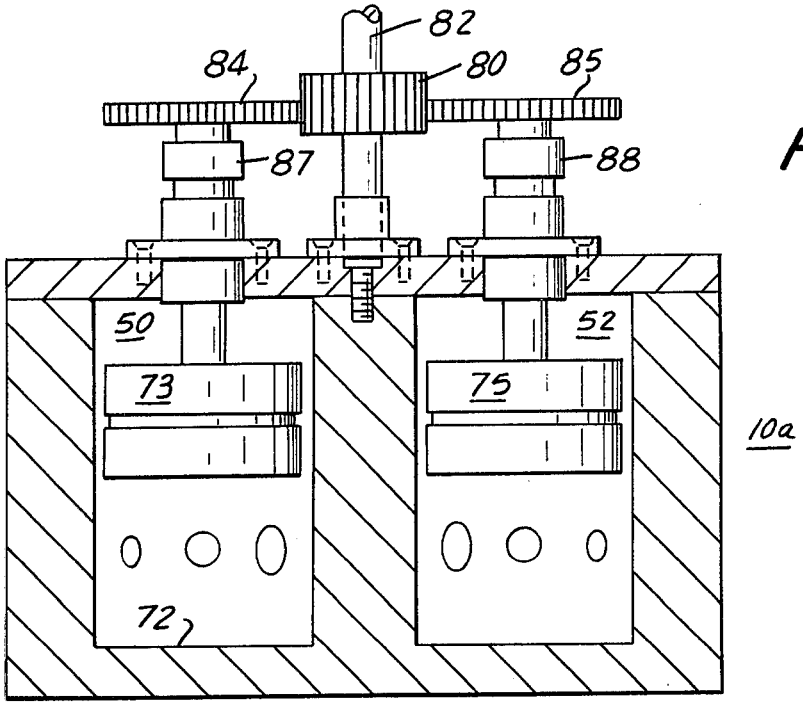
FIG. 4 is a side sectional view of FIG. 3 taken along lines 4—4.

Referring now to FIGS. 1 and 2, there is shown a tunable cavity waveguide filter 10 which is side wall coupled. Each of the cavities 11, 12 is circular in cross section with dimensions chosen to support a pair of $TE_{111}$ modes. The two modes are susceptively coupled through screws 31 and 32. An input iris 15 is provided in a side wall 11a of first cavity 11 from the front and an output iris 16 is taken from second cavity 12 from the rear.

It will be understood that an output may be taken 180° from the illustrated output 16 with both the output and input then being taken from the front. The input and output are typically coupled to the magnetic field of the input and output modes respectively. However, if the input is coupled to the E field, then it must be rotated 90° to realize the same response characteristic. Correspondingly, the output could be taken 90° from output 16 illustrated in the E field coupling is utilized.

Both cavities are tuned by conventional tuning plungers 20, 21 which are moved in synchronism at the same rate within cavities 11, 12, respectively. Thus, plunger 20 in cavity 11 is in the exact same relative position with respect to plunger 21 in the other cavity 12. As will later be described in detail, the rates of travel plungers 20, 21 are made the same since filter 10 is a symmetrical device. However, in a three cavity system (10*a*, FIGS. 3, 4 or 10*b*, FIGS. 5, 6) or other odd number of cavities system, the plungers are made to move at different rates and would be in different positions as a result of a symmetric susceptance loading caused by different irises between cavities. However, in each of the multicavity filters 10–10*b*, the resonant frequencies of all of the modes are maintained equal throughout the tuning range of the filter.

In cavity 11, tracking screws 25 and 26 are threadedly received within inner side wall 11a and extend out of the outer side wall of filter 10. Screws 25, 26 are placed mutually orthogonal to have a desired effect upon a particular mode in the first cavity. Specifically, screw 25 affects the first mode while screw 26 affects the second mode. Screws 25 and 26 provide susceptive loading for their resepctive modes so that resonant frequencies of the modes are maintained equal as tuning plunger 20 changes position within cavity 11. This is achieved by the orthogonal relationship between tracking screws 25, 26 and the fact that each of these screws is substantially wide and forms a chord of an arc on the inner side wall 11a of the cavity. This chordal relationship is shown in more detail for the example of screw 25 in FIG. 2A. As shown, ledge or face 25*a* of screw 25 meets inner side wall 11a at both the left and right sides forming a chord of an arc on the inner side wall.

As in cavity 11, cavity 12 has tracking screws 34 and 35 similarly mounted in a mutually orthogonal relationship on inner side wall 12a and extends out of the outer side wall of filter 10. Screw 34 affects the third mode while screw 35 affects the fourth mode. In the manner previously described with respect to cavity 11, screws 34 and 35 provide susceptive loading for their respective modes so that the resonant frequencies of the modes are maintained equal as tuning plunger 21 changes position within cavity 12. This is achieved by the orthogonal relationship and that screws 34 and 35 form a chord in the inner side wall 12*a* as previously set forth with respect to cavity 11.

In each of cavities 11, 12 the diameter of the respective tuning screws and the chordal relationship is necessary to obtain the required susceptance relationship between the modes so that the desired instantaneous response characteristic is realized for any position of the associated plunger. By this means, the cascading of cavities 11, 12 forming filter 10 provides the desired instantaneous response characteristic during simultaneous motion of the tuning plungers.

A further factor in the placement of the tracking screws which affects the instantaneous band width of filter 10 over desired tuning range is the longitudinal placement of the tracking screws with respect to their respective cavity long axis. Specifically, tracking screws 25, 26 are disposed on side wall 11a at a predetermined position with respect to long axis 17 of cavity 11. Similarly, screws 34 and 35 are disposed on side wall 12*a* with respect to long axis 18 of cavity 12. These predetermined distances with respect to the cavity bottom 28 are defined in the following manner.

In general, the tracking screws are disposed at a distance from cavity bottom 28 which is five-ninths the length of the cavity formed by the respective tuning plunger and bottom 28 when the cavity resonant frequency is the geometric center of the tuning range end points. For example, if each of the cavities 11, 12 tunes from 7.1 to 8.4 gHz, the respective tracking screws are placed with respect to bottom 28 five-ninths the length of the cavity having a center frequency $$\sqrt{7.1 \times 8.4} = 7.72 \text{ gHz} \quad (1)$$

In measuring the foregoing example in cavity 11, plunger 20 is first positioned at its uppermost end which defines the lower resonant frequency. Plunger 10 is then positioned at its lowermost end which defines the upper resonant frequency. The geometric center of the upper and lower resonant frequencies defines a cavity of intermediate length and screws 25 and 26 are placed five-ninths the way up from cavity bottom 28 in a direction of long axis 17 at that intermediate length. The measurement is taken at the center line of the screw. Iris 33, later to be described in detail, has its center line located at the above-defined geometric center of the tuning range end points.

The placement of tracking screws 25, 26 and 34, 35 with respect to long axes 17, 18, respectively, is of importance since otherwise it would not be possible to maintain the desired instantaneous band width characteristic across the tuning range of the filter.

Splitting screws 31, 32 are provided in cavities 11, 12, respectively to susceptively couple the energy from one mode of the other mode within each of the cavities. Specifically, screw 31 couples the first and second modes while screw 32 couples the third and fourth modes. Screws 31 and 32 have diameters and form chordal relationships with inner side walls 11a, 12a, in the manner described with respect to screws 25, 26 and 34, 35.

With respect to the positioning of the splitting screws, screw 31 is positioned with respect to screws 25 and 26 and screw 32 is positioned relative to screws 34 and 35 so that the magnetic fields of modes 2 and 3 are in phase opposition at iris 33. Thus, in the embodiment shown in FIGS. 1, 2, screw 31 is positioned between input iris 15 and screw 26 while screw 32 is positioned between output 16 and screw 34.

It will be understood that in another embodiment with input 15 moved 180° from its illustrated position, then screw 25 would also be moved 180° from its illustrated position. Thus screw 31 would then be between screws 25, 26. In a still further embodiment if output 16 were moved 180° then screw 35 would also be moved 180° and screw 32 would be moved 90°. Thus, screw 32 would be between screws 34, 35. No other changes of the screws would be required.

It will now be understood that by the above described placements of screws 25, 26 and 34, 35 and splitting screws 31, 32 the susceptive effect on each mode is maintained so that the resonant frequency of each mode is the same for every position of tuning plungers 20, 21.

In tunable filters, the mode $TM_{011}$ is an interfering mode which can cause spurious response and will cause the output characteristic to be not monotonic. In the multicavity system 10, this $TM_{011}$ spurious is suppressed since there may be avoided a line of sight coupling between input iris 15 and output 16. Thus in the illustrated embodiment of FIGS. 1, 2 with input 15 positioned as shown (or at 180° thereto) and with output 16 positioned as shown (or at 180°) there is not line of sight coupling between the input and output.

Iris 33 defines an aperture in the common wall of the first and second cavities. The coupling band width characteristic of the iris results from the polarizability of the iris which may be achieved by irises of many different configurations. As is known, it is desired to achieve correct polarizability between modes 2 and 3 while minimizing polarizability effect between andy of the other modes. In another embodiment it may be desired that there may be arbitrary coupling between modes other than 2 and 3 for special effects such as elliptical function responses. In a three cavity system 10a, as shown in FIGS. 3, 4, irises 55, 56 are selected so that there is correct polarizability between modes 2 and 3 and between modes 4 and 5. In a typical example, irises 33 and 55, 56 may each be long and slender with its longitudinal axis vertical or parallel to the longitudinal axis of the cavities.

The diameter and chordal relationship of tracking screws 25, 26 and 34, 35 and the diameter and chordal relationship of screws 31 and 32 are all of importance and an example is described below. From the design equations, for a center frequency of 6170 MHz, an instantaneous band width of 40 MHZ and a tuning range of 5925 to 6425 MHz, the diameter of cavities 11 and 12 may be 1.691 inches with the cavities having a variable length. Input iris 15 and output iris 16 would measure 0.6 inches × 0.312 inches. Iris 33 would measure 0.34 inches × 0.150 inches.

The curves illustrated in FIGS. 7–9 show the instantaneous band width with respect to center frequency $f_0$ for differing values of the diameter of screws 25, 26 and 31, with the depth of penetration in parenthesis as indicated. It will be understood that the curve for screw 25 is related also to screw 35; screw 26 is related to screw 34 and screw 31 is related to screw 32. It is to be noted that the best approximation with respect to optimum consistent with band width is observed for screw diameters such that diametric extremes are located at cavity radii. That is, the cross-sections of the screw form a chord with the cavity walls in the manner previously described. Thus it will be understood that the screws define chordal relationships with the screw diameter selected according to well known design equations which provide for the iris susceptances.

As previously described, both plungers 20 and 21 move synchronously and are always at the same distance with respect to the cavity bottom 28. Plungers 20, 21 are formed as double plungers and are secured to bottom ends of shafts 40, 41, respectively. Shafts 40, 41 have intermediate their bottom and top ends threaded sections 40a, 41a which engage tuning nuts 43, 44 respectively. Tuning nuts 43, 44 are secured as for example by screws 45 to the upper outer surface of filter 10.

Driving gear 47 and driven gear 48 have central openings for fixedly receiving upper sections of shafts 40, 41 respectively. The teeth of gears 47, 48 have the same pitch and engage each other, as shown. Shaft 40 extends upwardly from gear 47 and may be driven manually by means of a knob or other means. It will be understood that the pitch of the threads of tuning nuts 43, 44 (as well as threads 40*a*, 41*a*) are identical. It is in this manner that as shaft 40 is turned, plunger 20 moves either upwardly or downwardly. At the same time gear 48 is driven moving plunger 21 upwardly or downwardly synchronously with plunger 40. With the pitches being identical, plungers 20, 21 move together and are always at the same distance from cavity bottom 28. It will also be understood that the teeth of gears 47 and 48 are selected to provide a desired turn ratio.

Referring now to filter 10*a*, there is shown a three cavity dual mode system having an input iris 53 and an output iris 56. A first of the cavities 50 has tracking screws 58, 59; a second of the cavities 51 has tracking screws 61, 62; and a third of the cavities 52 has tracking screws 64, 65. Further, cavities 50–52 have splitting screws 66–68, respectively. In each of cavities 50–52, the tracking and splitting screws have orthogonal positions and chordal relationships similar to that described with respect to filter 10.

It will be understood that the tracking and splitting screws and center line of irises 53–56 are positioned with respect to the geometric center of the tuning range end points in the manner previously described.

In filter system 10a, plungers 73, 75 of cavities 50, 52, respectively and the plunger (not shown) of cavity 51, do not move synchronously for the reasons previously described. However, the resonant frequency of the modes in each of the cavities is maintained equal by proper selection of the splitting screws, tracking screws and irises.

In moving the plungers upwardly and downwardly, there is provided a drive gear 80 having a drive shaft 82 which is driven by means of a knob or other means. Drive gear 80 meshes with gears 84, 85 and with a third gear for cavity 51 (not shown). The gears are secured to respective shafts which are threaded and engage tuning nuts 87, 88 of cavities 50, 52 respectively. The third tuning nut for cavity 51 is not shown. The pitch of the outside pair of tuning nuts, nuts 87, 88 are selected to have the same pitch. The pitch for the tuning nut of the cavity 51 is selected to have a different pitch. In calculating the proper instantaneous band width, the upper and lower extremes of the respective plungers are taken and then the sizes and positions of the splitting and tracking screws as well as the irises are calculated. From these calculations, the pitch of the tuning nut of cavity 51 is determined.

It will be understood that in filter systems having five, seven or other odd number cavities, the outer pair of cavities have tuning nuts with the same pitch. In addition, the pair of cavities one in from the outside pair also have the same pitch, and so on. The central cavity always has a different pitch.

Figure 5:
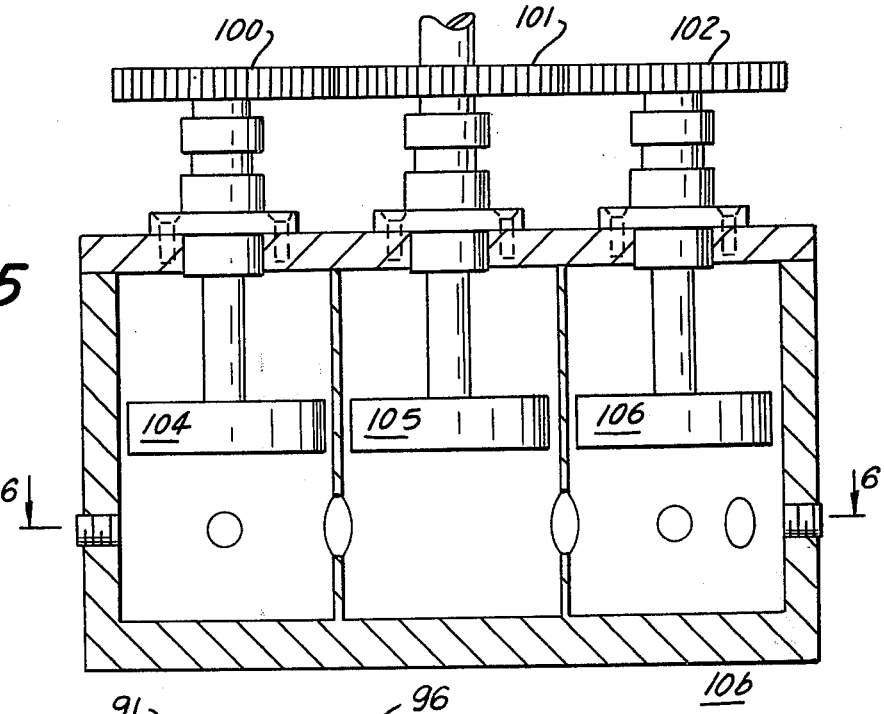
FIG. 5 is a side sectional view of a three cavity filter two of which cavities are dual mode and one of which cavities is single mode according to a further embodiment of the invention.
Figure 6:
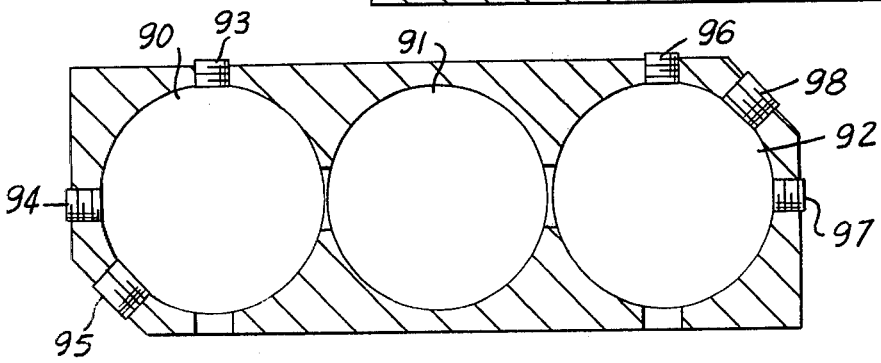
FIG. 6 is a top sectional view of FIG. 5 taken along lines 6—6.

In FIGS. 5 and 6, there is shown a further embodiment of the invention in which filter system 10*b* has a first and a third cavity 92 of dual mode while the middle or a second cavity 91 is of single mode. It is in this way that there is achieved a five pole response. This five pole response is between the four pole response of filter system 10 and the six pole response of filter system 10*a*. It will also be understood that a filter system (not shown) may have two cavities with the first cavity being dual mode and the second cavity single mode for a three pole response. Other combinations for other odd pole responses may be designed in the foregoing manner.

In filter system 10*b*, cavity 90 has tracking screws 93, 94 and splitting screw 95 while cavity 92 has tracking screws 96, 97 and splitting screw 98. Driving gear 101 is effective upon being turned to drive gears 100, 102 thereby moving plungers 104–106 upwardly or downwardly.

What is claimed is:

1. A multicavity waveguide filter comprising a plurality of cylindrical cavities in which each of said cavities has a pair of orthogonally related modes of propogation, a plunger for tuning each of said cavities, each of said plungers being disposed within a respective cavity, each of said cavities having a side wall and being positioned side by side in a series with the long axis of each of said cavities being aligned parallel to each other but not coaxial, each of said cavities having obstacle splitting means for coupling each pair of orthogonally related modes within the cavity, iris means formed on a side wall of each of said cavities for coupling selected one of said cavities, and means mechanically coupling said tuning plungers for simultaneously moving said tuning plungers to predetermined positions within said cavities.

2. The filter of claim 1 in which for each of said cavities said obstacle splitting means for coupling each pair of modes are at a position on the cavity wall defined by the geometric center of the tuning range end points, said end points determined by predetermined extreme positions of the plunger.

3. The system of claim 2 in which there is provided a pair of tracking devices in each cavity one for each mode, each of said tracking devices having an area and poisition within the cavity to provide a resonant frequency for each of said modes whereby the resonant frequencies are maintained equal for respective positions of the plungers.

4. The system of claim 3 in which said means for simultaneously moving said plungers is adjusted so that the resonant frequency of each pair of modes within a cavity varies at the same rate with respect to each of the other pairs of modes within the other ones of said cavities.

5. The system of claim 3 in which there is provided an additional cavity having a single modes, additional iris means formed on a side wall for coupling said additional cavity to a selected one or more of said cavities.

6. The system of claim 1 in which there is provided an input to a first of said plurality of cavities and an output from a last of said plurality of cavities with no direct line of sight between said input and output.

7. The system of claim 6 in which said input is coupled into the magnetic field of a first of said pair of modes of said first cavity and the output is coupled into the magnetic field of a second of said pair of modes of said last cavity.

8. The system of claim 6 in which said input is coupled into the E or magnetic field of a first mode of said first cavity and the output is coupled into the E or magnetic field of a second mode of said last cavity.

* * * * *